US011519425B2

(12) United States Patent
Durand

(10) Patent No.: US 11,519,425 B2
(45) Date of Patent: Dec. 6, 2022

(54) COMPRESSION DEVICE AND METHOD

(71) Applicant: L'Air Liquide, Societe Anonyme pour l'Etude et l'Exploitation des Procedes Georges Claude, Paris (FR)

(72) Inventor: Fabien Durand, Voreppes (FR)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 171 days.

(21) Appl. No.: 16/756,827

(22) PCT Filed: Aug. 9, 2018

(86) PCT No.: PCT/FR2018/052043
§ 371 (c)(1),
(2) Date: Apr. 16, 2020

(87) PCT Pub. No.: WO2019/077213
PCT Pub. Date: Apr. 25, 2019

(65) Prior Publication Data

US 2020/0271129 A1 Aug. 27, 2020

(30) Foreign Application Priority Data

Oct. 16, 2017 (FR) ..... 1701075

(51) Int. Cl.
*F04D 29/58* (2006.01)
*F04D 17/12* (2006.01)
(Continued)

(52) U.S. Cl.
CPC ..... *F04D 29/5806* (2013.01); *F04D 17/12* (2013.01); *F04D 25/024* (2013.01);
(Continued)

(58) Field of Classification Search
CPC ..... F04D 29/5806; F04D 17/12; F04D 25/06; F04D 25/024; F04D 29/5826;
(Continued)

(56) References Cited

U.S. PATENT DOCUMENTS 664,469 A 12/1900 Copeland
5,980,218 A 11/1999 Takahashi et al.
(Continued)

FOREIGN PATENT DOCUMENTS

| | | |
|---|---|---|
| CN | 105 765 234 | 7/2016 |
| EP | 2 273 130 | 1/2011 |
| JP | 2018-189079 | 11/2018 |

OTHER PUBLICATIONS

International Search Report and Written Report for PCT/FR2018/052043, dated Nov. 28, 2018.
French Search Report for FR 1 701 075, dated Jun. 25, 2018.

*Primary Examiner* — Kenneth J Hansen
*Assistant Examiner* — David N Brandt
(74) *Attorney, Agent, or Firm* — Christopher J. Cronin

(57) ABSTRACT

Device and method for centrifugal compression of a working gas comprising a plurality of centrifugal compressors forming a plurality of compression stages and plurality of drive motors for driving the compressors, the device comprising a gas circuit comprising a first, inlet, pipe for the gas to be compressed, connected to an inlet of a first compressor, the circuit comprising a second pipe connected to an outlet of said first compressor, the second pipe being connected to an inlet of a second compressor, the circuit comprising at least one third, cooling, pipe having one end connected to the outlet of at least one of the compressors and at least one second end connected to an inlet of at least one motor for cooling thereof, the third, cooling, pipe comprising a first member for cooling the gas and two parallel branches
(Continued)

respectively supplying two distinct motors of the device for their respective cooling.

7 Claims, 1 Drawing Sheet

(51) Int. Cl.
*F04D 25/02* (2006.01)
*F04D 25/06* (2006.01)

(52) U.S. Cl.
CPC ..... *F04D 25/0606* (2013.01); *F04D 29/584* (2013.01); *F04D 29/5826* (2013.01)

(58) Field of Classification Search
CPC ..... F04D 29/5833; F04D 29/584; F04D 25/0606; F25B 1/10; F25B 31/006; F25B 41/20; F25B 41/40
See application file for complete search history.

(56) References Cited

U.S. PATENT DOCUMENTS

| | | | | |
|---|---|---|---|---|
| 6,464,469 | B1 | 10/2002 | Grob et al. | |
| 8,899,945 | B2 | 12/2014 | Laboube | |
| 2001/0037651 | A1* | 11/2001 | Butterworth | F04D 29/5806 62/468 |
| 2015/0159674 | A1* | 6/2015 | Lee | F04D 29/5806 415/66 |
| 2016/0265545 | A1 | 9/2016 | Ueda et al. | |
| 2017/0159665 | A1* | 6/2017 | Bergamini | F04D 13/06 |

* cited by examiner

COMPRESSION DEVICE AND METHOD

CROSS-REFERENCE TO RELATED APPLICATIONS

This application is a § 371 of International PCT Application PCT/FR2018/052043, filed Aug. 9, 2018, which claims § 119(a) foreign priority to French patent application FR 1701075, filed Oct. 16, 2017.

BACKGROUND

Field of the Invention

The invention relates to a compression device and method, as well as a refrigeration machine.

More specifically, the invention relates to a centrifugal compression device for a working gas, notably for a refrigeration machine, including several centrifugal compressors forming several successive and/or parallel compression stages and several drive motors for the compressors, the device having a gas circuit comprising a first inlet line for the gas to be compressed that is linked to an inlet of a first compressor to convey the gas to be compressed into the first compressor, the circuit having a second line linked to an outlet of said first compressor to discharge the gas compressed in the latter, the second line being linked to an inlet of a second compressor to convey the gas compressed in the first compressor into the second compressor in order to perform a second compression, the circuit having at least one third cooling line with one end connected to the outlet of at least one of the compressors and at least one second end connected to an inlet of at least one motor for transferring a fraction of the gas compressed in the at least one compressor into the at least one motor in order to limit the heating of the latter.

Related Art

A centrifugal compressor using a direct drive between the (electric) motor and the compression wheel or wheels (i.e. with no step-up gear) requires a gas flow to discharge the heat generated in the motor. This heat is generated primarily by the losses from the motor and by friction between the rotor and the gas surrounding same.

This cooling flow is conventionally injected at one side of the motor (at an inlet) and discharged from the other side (at an outlet) at a higher temperature. The cooling flow can also be injected in the middle of the motor and discharged from both sides of the motor.

A greater or lesser part of the heat is also conventionally discharged by a heat-transfer fluid flowing in a circuit surrounding the stator portion of the motor (water or air or any other heat-transfer fluid used to cool the stator).

In order to prevent the loss or contamination of the compressed gas, the gas flowing through the motor to cool the motor usually has the same composition as the compressed gas.

In order to limit the quantity of equipment required, the motive force required to cause the gas to flow through the motor or motors is generated by one or more compression stages (i.e. by one or more compressors).

There are several known examples that use this cooling technique.

Document U.S. Pat. No. 6,464,469 describes the use of a portion of the gas leaving the first compression stage to cool the motor. This gas is then returned to the inlet of the compressor.

Document U.S. Pat. No. 5,980,218 describes the use of a portion of the gas leaving the cooling exchanger located downstream of the first compression stage to cool the motor. This gas is then returned to the inlet of the compressor.

Document U.S. Pat. No. 8,899,945 describes an architecture with several motors.

However, these solutions are ill-suited to an architecture with several motors and/or the performance levels are unsatisfactory.

SUMMARY OF THE INVENTION

One objective of this invention is to mitigate some or all of the drawbacks of the prior art as set out above.

For this purpose, the device according to the invention, while corresponding to the general definition given in the preamble above, is essentially characterized in that the third cooling line includes a first gas cooling member and two parallel branches supplying respectively two separate motors of the device with a view to respectively cooling same.

Furthermore, the embodiments of the invention may have one or more of the following features:

- the third cooling line includes a set of control valves for the gas flow admitted into the two parallel branches,
- the set of valves includes two control valves positioned respectively in the two branches,
- the set of valves includes a three-way control valve positioned at the junction of the two branches or a single valve positioned on the third line, upstream of the two branches,
- the first gas cooling member includes a heat exchanger cooled by a heat-transfer fluid,
- the circuit includes fourth lines linking an outlet of the first motor and an outlet of the second motor to the inlet of the first compressor to recycle the gas that was used to limit the heating of the motors to the first compressor in order to compress said gas,
- the circuit includes at least one second gas cooling member arranged on the path of the fourth lines to remove heat from the gas coming from the motors before said gas returns to the first compressor,
- the compressors are driven in rotation directly by the corresponding motors,
- the device includes one or more rotary joints between the motor or motors and the compressor or compressors or one or more expansion stages such that the pressure in the cavities of the motor or motors is close to the lowest pressure in the compressor, i.e. the inlet pressure of the compressor,
- the device includes at least one motor driving one or more compressors and at least one motor coupled to one or more expansion turbines.

The invention also concerns a refrigeration machine at low temperature between −100° C. and −273° C. including a working circuit containing a working fluid, the working circuit including a centrifugal compression device and a device for cooling and expanding the gas compressed in the compression device, characterized in that the compression device has any of the features described above or below.

The invention also relates to a centrifugal compression method for a working gas, notably fora refrigeration machine, using several centrifugal compressors forming several successive and/or parallel compression stages and several drive motors for the compressors, the compressors being driven in rotation directly by the motors, the method including:

a step for compressing a working gas in a first compressor then in a second compressor arranged in series, a step for drawing off a fraction of the compressed gas leaving at least one of the compressors and causing this gas drawn off to flow through at least one motor in order to cool same, the method including a cooling step for the gas drawn off at the outlet of the at least one compressor and a step in which said drawn off cooled gas is distributed and caused to flow in parallel through two separate motors in order to respectively cool same.

The invention may also relate to any alternative device or method including any combination of the features set out above or below.

BRIEF DESCRIPTION OF THE FIGURES

Other features and advantages are set out in the description below, provided with reference to the figures in which.

DETAILED DESCRIPTION OF THE INVENTION

Figure 1:
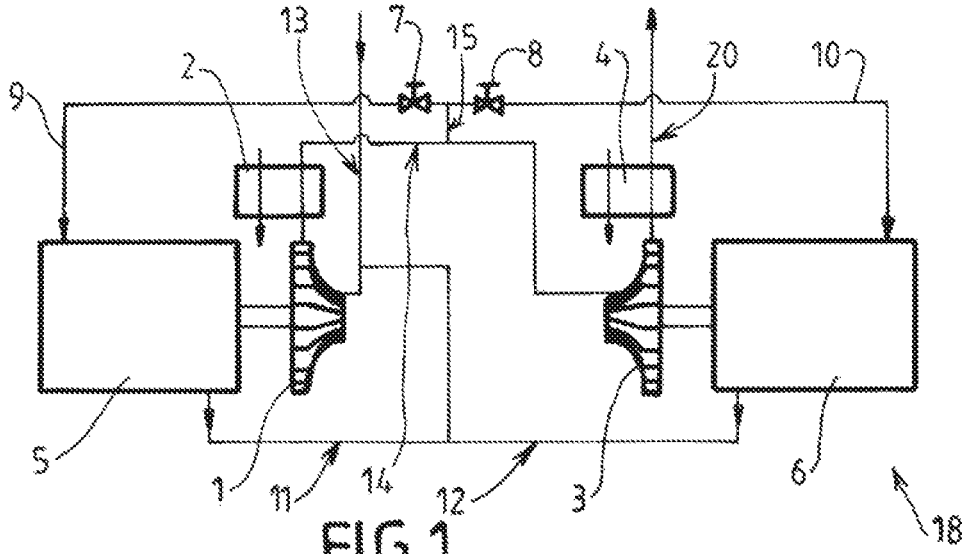
FIGS. 1 and 2 are partial schematic views showing respectively two examples of the structure and operation of a compression device according to the invention.

The compression device 18 shown schematically in FIG. 1 includes two centrifugal compressors 1, 3 (i.e. two compressor wheels) forming two successive compression stages.

Each of the two compressors 1, 3 is driven by a respective drive motor 5, 6 (which is preferably electric).

Preferably, the compressors 1, 3 are driven in rotation directly by their corresponding motor 5, 6.

The device 18 has a gas circuit comprising a first inlet line 13 for the gas to be compressed that is linked to the inlet of the first compressor 1 to convey the gas to be compressed into the first compressor 1.

The circuit has a second line 14 with an upstream end linked to an outlet of said first compressor 1 to discharge the gas compressed in the latter. The second line 14 has a downstream end that is linked to an inlet of the second compressor 3 to convey the gas that has been compressed in the first compressor 1 into the second compressor 3 in order to perform a second compression (a second compression stage).

The circuit includes a third cooling line 15 with an upstream end linked to the outlet of the first compressor 1 (for example via the second line 14) and two second downstream ends linked respectively to the inlets of the second motor 5, 6. In other words, for example, the third line 15 includes a portion shared with the second line 14.

In other words, the third line 15 forms a bypass from the second line 14 between the first compressor 1 and the second compressor 3.

This third line can then be a bypass from the second line 14 (and/or a separate line).

In other words, the third line 15 draws off a fraction of the compressed gas intended to supply the second compressor 3 to sweep (cool) the two motors 5, 6. This fraction can be 1% to 40% of the gas flow coming out of the first compressor 1.

The gas flow in each of the two branches supplying the motors 5, 6 respectively can be controlled by a set of valves 7, 8 (or any other appropriate member, notably a differential pressure member such as an orifice, a capillary, etc.). In the example shown, two valves 7, 8 positioned respectively in the two parallel branches ensure the distribution of compressed cooling gas to the motors 5, 6.

In a variant, the third single line 15 can be duplicated. In other words, two separate line portions 15 are connected respectively to the two parallel branches and to the two valves 7, 8, or equivalent. There may also be a single control valve positioned in the shared portion of the two branches (in the line portion between the second line 14 and the two parallel branches linked to the motors 5, 6).

Furthermore, the compressed gas coming out of the first compressor 1 is preferably cooled, for example by a first gas cooling member 2 such as a heat exchanger performing a heat exchange with a heat-transfer fluid.

The cooling of the gas intended to supply and cool the motors may be performed on the third line 15 (between the second line 4 and the two parallel branches) and/or downstream (on the parallel branches). This cooling member (2 or other) may be dimensioned to cool the gas to a lower temperature, for example 0° C. (for example via a cooling unit) to improve cooling of the motor or motors.

Thus, the gas is cooled before being distributed to the two branches of the fourth line.

Thus, this cooling can be performed using an exchanger 2 (or other) at the outlet of the compressor 1 as shown in the figure and/or downstream in the bypass 15 and/or in the branches using an exchanger or any other member intended to cool the gas to any extent.

In other words, the circuit provides a parallel supply to the two motors 5, 6. Having flowed through the motors 5, 6, this gas is then returned to the inlet of the first compressor 1 via fourth lines 11, 12.

The fourth lines 11, 12 can also be used, if necessary, to recover the gas from any leaks (for example in the joints located near to the motors, such as rotary joints for example).

In a possible non-limiting example, the mechanical power required to compress a flow of 1.26 kg/s of nitrogen gas initially at a pressure of 5 bars absolute and a temperature of 288 K to a pressure of 18.34 bars absolute is approximately 200 kW (100 kW per motor).

For example, the nitrogen is compressed to 8.87 bars absolute in the first centrifugal compression stage (first compressor 1) with a power of 95 kW and a typical isentropic efficiency of 86%. The compressed gas is then cooled in the exchanger 2. As described above, a portion of the gas is drawn off via the valves 7 and 8 to cool the motors 5 and 6.

The main flow is then compressed again to a pressure of 18.34 bars absolute in the second centrifugal compression stage 3. This second compressor 3 for example has a power of 95 kW and a typical isentropic efficiency of 86%. The gas is then cooled in an output heat exchanger 4 before being conveyed to the outlet 20 of the compression device 18.

Of the 100 kW of work/power of the motors 5, 6, 5% is typically transformed into heat (losses from the electric motor and losses through friction of the rotor with the nitrogen), i.e. approximately 5 kW per motor 5, 6.

A portion of the nitrogen flow at the outlet of the first cooling exchanger 2 is then conveyed through a first valve 7 and a first branch 9 to the first motor 5 in order to cool same.

The temperature increase in the gas through the motor 5 is typically limited to 30 K (to limit the heating of the motor 5) by controlling the valve 7.

This can be translated by a mass flow=Power/Cp/deltaT=5000/1048/30=0.159 kg/s.

Where Cp=thermal capacity of the gas (nitrogen in this example) in J/kg/K . . . .

delta T=the temperature variation in the gas between the lines 9 and 11 in K.

Power=the losses from the motor to be discharged by the gas in W. The gas flowing through the motor 5 then leaves the motor 5 via the fourth line 11 and returns to the inlet of the first compressor 1.

The same process occurs in parallel for the second motor 6 (via the valve 8 and the lines 10, 12).

Upon leaving the two motors 5, 6 via the respective fourth lines 11, 12, the nitrogen at 318 K (288 K+30 K increase) is mixed with the nitrogen coming from the inlet 13 of the compressor 1. This can increase the temperature of the nitrogen at the inlet of the first compression stage 1 to 294.5 K and can cause an increase in the energy consumption of this compression stage 1 by increasing the volume flow.

Even if there is an increase in energy consumption, this architecture improves overall efficiency compared to known solutions. Indeed, the temperatures of the two motors are controlled at the expense of acceptable efficiency.

Figure 2:
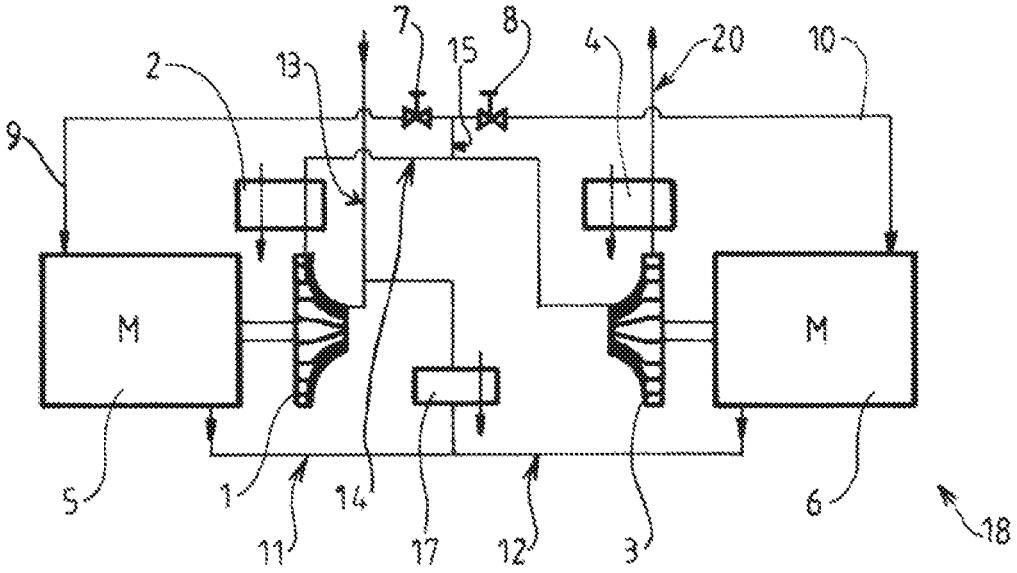

If required and as shown schematically in FIG. 2, a second cooling member 17 can be provided in the circuit for cooling the gas coming out of the motors 5, 6 before being returned to the first compressor 1.

In other words, the cooling gas coming out of the motor or motors 5, 6 can be cooled for example using a heat exchanger 17 before returning to the main circuit of the compressor 1.

The efficiency of the device is improved by lowering the temperature of the cooling gas before returning said gas to the inlet of the compressor 1.

This cooling gas coming from the motors 5, 6 via the fourth lines 11, 12 is preferably cooled to a temperature equal or close to the temperature of the gas at the inlet 13 of the compressor 1.

In the example in FIG. 6, the mechanical power required to compress a flow of 1.26 kg/s of nitrogen gas at an initial pressure of 5 bars absolute and a temperature of 288 K to a pressure of 18.34 bars absolute is approximately 198 kW (98 kW for the first motor 5 and 100 kW for the second motor 6).

This results in a 1% reduction in consumed power compared to the previous device.

The nitrogen is compressed to 8.87 bars absolute in the first centrifugal compression stage 1, for example with a power of 93 kW and a typical isentropic efficiency of 86%. The gas is then cooled in the exchanger 2. A portion of the gas is drawn off via the valves 7, 8 to cool the motors 5, 6.

The main flow is then compressed to 18.34 bars absolute in the second centrifugal compression stage 3. This second compression stage for example has a power of 95 kW and a typical isentropic efficiency of 86%. The gas is then cooled in the second heat exchanger 4 before being conveyed to the outlet 20 of the compression device (in this case of the second compressor 3). Of the 98 kW and 100 kW of power supplied respectively by the motors 5, 6, typically 5% is transformed into heat (losses from the electric motor, losses through friction of the rotor with the nitrogen, etc.), i.e. approximately 5 kW per motor 5, 6.

A portion of the nitrogen flow at the outlet of the first cooling exchanger 2 is then conveyed through the first valve 7 and the branch 9 to the motor 5 in order to cool same. The temperature increase in the gas through the motor 5 is typically limited to 30 K (to limit the heating of the motor 5) by controlling the valve 7.

As before, this results in a mass flow equal to Power/Cp/deltaT=5000/1048/30=0.159 kg/s.

The nitrogen is then discharged from the motor 5 via the fourth line 11 and returns to the heat exchanger 17 before returning to the inlet of the first compressor 1.

The same process is carried out for the other motor 6 (cooling gas via the valve 8, the lines 10 and 12 and the exchanger 17).

On leaving the heat exchanger 17, the nitrogen at 288 K is mixed with the nitrogen coming from the inlet 13 of the compressor 1. This has no effect on the temperature of the nitrogen at the inlet of the first stage 1 (unlike in the previous device). Overall efficiency is improved.

Naturally, the invention is not limited to these exemplary embodiments.

For example, the cooled gas used to cool the motors 5, 6 can be drawn off at the outlet of a second compression stage 3 and/or a later compression stage.

Furthermore, several compression stages can be driven by a single motor. Moreover, one or more expansion stages (turbines) can be coupled to at least one of the motors.

Furthermore, in addition to the compression stage or stages 1, 2, one or more expansion stages (turbines, preferably centripetal turbines) can be mounted on the same drive shaft as one or more compressors.

Furthermore, at least one bypass valve can be mounted on the cooling circuit such as to limit the flow passing through one or more motors.

The cooling gas flow to a motor 5, 6 can be controlled by one or more expansion members 7, 8. This member or these members can advantageously be adjustable for example as a function of the temperature of one or more motors and/or the cooling flow and/or the temperature of the cooling gas.

Furthermore, these expansion members 7, 8 can, where necessary, cool the gas before the gas enters the motor or motors.

Thus, the valves 7, 8 can be replaced by or associated with one or more turbines and/or Ranque-Hilsch vortex tubes. Moreover, these members 7, 8 can be positioned on the line 15 between the second line 14 and the two parallel branches.

Furthermore, rotary joints can be used between the motor or motors 5, 6 and the compression stage or stages 1, 3 or the expansion stage or stages such that the pressure in the cavities of the motor is close to the lowest pressure in the compressor, i.e. the inlet pressure 13 of the compressor. This reduces the losses through friction between the rotor or rotors and the gas since these losses are proportional to the pressure in the cavity of the motor.

Figure 3:
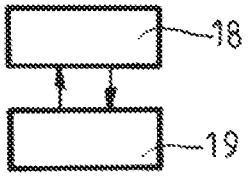
FIG. 3 is a partial schematic view showing an example of the structure and operation of a cooling machine including such a compression device.

As shown in FIG. 3, the compression device 18 can be part of a refrigeration machine at low temperature, for example between −100° C. and −273° C. including a working circuit 10 containing a working fluid, the working circuit including a centrifugal compression device 18 and a device 19 for cooling and expanding the gas compressed in the compression device 18.

The working gas can be made up in full or in part of nitrogen, helium, hydrogen, neon, argon, carbon monoxide, methane, krypton, xenon, ethane, carbon dioxide, propane, butane and oxygen.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A centrifugal compression device for a working gas for a refrigeration machine, comprising: a plurality of centrifugal compressors forming several successive and/or parallel compression stages, the plurality of centrifugal compressors comprising first and second centrifugal compressors; a plurality of drive motors for the plurality of centrifugal compressors, the plurality of drive motors comprising first and second drive motors; and a gas circuit comprising: a first inlet line for the working gas linked to an inlet of the first centrifugal compressor for conveying the working gas into the first compressor, a second line linked to an outlet of the first centrifugal compressor and an inlet of the second centrifugal compressor to convey the working gas from the first centrifugal compressor to the second centrifugal compressor, at least one third cooling line; one end of each of the at least one third cooling line connected to an outlet of at least one of the plurality of centrifugal compressors, and at least one second end of each of the at least one third cooling line connected to an inlet of an associated one of the plurality of drive motors for transferring a fraction of working gas from one of the plurality of centrifugal compressors into the first and second drive motors in order to limit heating of each of the drive motors that receives the fraction of working gas, the second line including a first gas cooling member and two parallel branches supplying the first and second drive motors, respectively, for cooling purposes, fourth lines linking an outlet of the first drive motor and an outlet of the second drive motor to the inlet of the first centrifugal compressor to recycle working gas that was used to limit the heating of the first and second drive motors in order to compress the recycled working gas, and at least one second gas cooling member arranged on the fourth lines to remove heat from the working gas coming from the first and second drive motors before being returned to the first centrifugal compressor.

2. The device of claim 1, wherein the third line includes a set of control valves for controlling flow of working gas admitted into the two parallel branches.

3. The device of claim 2, wherein the set of control valves comprises first and second control valves, each of which is positioned in a respective one of the two parallel branches.

4. The device of claim 2, wherein the set of control valves includes a three-way control valve positioned at a junction of the two parallel branches.

5. The device of claim 1, wherein the third line includes a single control valve, upstream of the two branches, for controlling flow of working gas admitted into the two parallel branches.

6. The device of claim 1, wherein the first gas cooling member includes a heat exchanger cooled by a heat-transfer fluid.

7. The device of claim 1, wherein the first centrifugal compressor is driven in rotation directly by the first drive motor; the second centrifugal compressor is driven in rotation directly by the second drive motor.

* * * * *